US008455764B2

(12) United States Patent
Persson et al.

(10) Patent No.: US 8,455,764 B2
(45) Date of Patent: Jun. 4, 2013

(54) SUPPORT BRACKET

(75) Inventors: Jonas Persson, Luleå (SE); Anders Jansson, Piteå (SE); Anders Strömbeck, Luleå (SE); Benny Wedin, Grängesberg (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 13/284,499

(22) Filed: Oct. 28, 2011

(65) Prior Publication Data

US 2012/0043112 A1 Feb. 23, 2012

Related U.S. Application Data

(63) Continuation of application No. PCT/EP2010/055472, filed on Apr. 23, 2010.

(30) Foreign Application Priority Data

Apr. 29, 2009 (EP) ..... 09159058

(51) Int. Cl.
*H01B 17/00* (2006.01)

(52) U.S. Cl.
USPC ..... 174/158 R; 174/137 R; 174/172; 174/174

(58) Field of Classification Search
USPC ..... 174/58 R, 137 R1, 172, 174
See application file for complete search history.

(56) References Cited

U.S. PATENT DOCUMENTS

| | | | | |
|---|---|---|---|---|
| 4,250,927 | A * | 2/1981 | Newburg | 138/113 |
| 4,562,321 | A * | 12/1985 | Bolongeat-Mobleu et al. | 218/57 |
| 8,049,108 | B2 * | 11/2011 | Hartings et al. | 174/142 |
| 8,319,101 | B2 * | 11/2012 | Adachi et al. | 174/73.1 |
| 2005/0016752 | A1 * | 1/2005 | Hiroshi et al. | 174/73.1 |
| 2005/0241928 | A1 * | 11/2005 | McCord et al. | 200/400 |

FOREIGN PATENT DOCUMENTS

| | | |
|---|---|---|
| DE | 2654753 A1 | 6/1978 |
| EP | 0141708 A2 | 5/1985 |

OTHER PUBLICATIONS

International Search Report and Written Opinion of the International Searching Authority; Application No. PCT/EP2010/055472; Issued: May 20, 2010; Mailing Date: May 27, 2010; 10 pages.

* cited by examiner

*Primary Examiner* — Timothy Thompson
*Assistant Examiner* — Rhadames J Alonzo Miller
(74) *Attorney, Agent, or Firm* — St. Onge Steward Johnston & Reens LLC

(57) ABSTRACT

A support bracket for supporting insulating rods inside an insulator tube of a hollow core insulator. The support bracket includes a cylindrical ring with an outer surface for abutting against the inner surface of an insulator tube, an inner surface for supporting an insulating rod and two opposing end sides, denominated by first and second end sides. The support bracket includes an expansion assembly configured to be actuated so as to expand the cylindrical ring in at least one radial direction when the support bracket has been inserted in an insulator tube of a live tank circuit breaker.

14 Claims, 4 Drawing Sheets

SUPPORT BRACKET

CROSS-REFERENCE TO RELATED APPLICATIONS

The present application is a continuation of pending International patent application PCT/EP2010/055472 filed on Apr. 23, 2010 which designates the United States and claims priority from European patent application 09159058.8 filed on Apr. 29, 2009. The content of all prior applications is incorporated herein by reference.

FIELD OF THE INVENTION

The present invention relates to a support bracket for supporting insulating rods inside an insulator tube of a hollow core insulator.

BACKGROUND OF THE INVENTION

High voltage power circuit breakers today are generally grouped into two classes: live tank and dead tank designs. A dead tank circuit interrupter generally is one in which the interrupting unit, with its separating contacts, is disposed within an electrically grounded metal tank which then is disposed on or at physical ground level. A live tank design, on the other hand, has its interrupting unit, with its separating contacts, disposed in an insulating tube which then is supported upon an insulating column.

The interrupting unit of a live tank circuit breaker usually consists of an insulating rod which is disposed in the insulator tube of the live tank circuit breaker and configured to be movable in a direction parallel to the longitudinal direction of the insulator tube. Also, the insulating rod needs to be centered inside the insulator tube, and/or supported to avoid buckling, which usually is accomplished by having the insulator tube provided with support brackets fixed to its inside surface. The support brackets in question are usually ring-shaped and their outer circular surfaces have to be attached to the inside surface of the insulator tube, and their inside surface configured to support the insulating rod. Earlier a support bracket for the above-mentioned purpose consisted of a solid ring which was fixed to the inside of the insulator tube by means of an adhesive joint.

SUMMARY OF THE INVENTION

The object of the present invention is to provide a new support bracket for supporting insulating rods inside an insulator tube of a hollow core insulator.

This object is according to the invention obtained by providing a support bracket, wherein the support bracket comprises a cylindrical ring, preferably a circular cylindrical ring, with an outer surface for abutting against the inner surface of an insulator tube, an inner surface for supporting an insulating rod and two opposing end sides, here denominated first and second end sides, the support bracket being configured to be inserted into an insulator tube of a hollow core insulator so that the cylinder axis of the cylindrical ring essentially coincide with the central longitudinal axis of said insulator tube, wherein the support bracket comprises an expansion assembly having means configured to be actuated so as to expand the cylindrical ring in at least one radial direction when the support bracket has been inserted in an insulator tube of a hollow core insulator.

In this description and the subsequent claims, the expression "cylindrical ring" is referring to a ring which essentially has a cylindrical shape, however, the shape of the ring can also differ slightly or significantly from the shape of a cylinder, e.g. the ring can have its outer and/or inner surface shaped as a hyperboloid or the outer and/or the inner surface can have irregular recesses or protrusions.

The hollow core insulator can for instance be the supporting insulator of a live tank circuit breaker, and the inner surface and the outer surface of the cylindrical ring can of course be surfaces of two separate parts which are jointed to constitute the cylindrical ring.

Accordingly, by expanding the cylindrical ring of the support bracket inside the insulator tube the support bracket will be fixed to the inside of said insulator tube by a mechanical joint instead of an adhesive joint relying on adhesive bonding, as was the case before. An adhesive joint is very difficult to apply inside an insulator tube since the adhesive tends to stick to other parts of the inside surface of the tube than those intended. On the contrary, the support bracket according to the invention is during mounting inserted into the insulator tube and thereafter the cylindrical ring is expanded by actuation of said means of the expansion assembly. The mechanical joint relies on radial stress and friction between the outer surface of the cylindrical ring and the inner surface of the insulator tube and no adhesive is necessary for the mounting of the support bracket to the inside of the insulator tube.

According to one embodiment of the invention said means is accessible for actuation from the first end side of the cylindrical ring. The means to be actuated so as to expand the cylindrical ring can thereby easily be accessible while the support bracket is inserted in the insulator tube, which would not be the case if for instance said means were actuated from a radial direction of the cylindrical ring.

According to another embodiment of the invention the expansion assembly comprises a radial slit which opens the cylindrical ring, and said means of the expansion assembly is configured to be actuated so as to expand the cylindrical ring by expanding the width of the radial slit. The cylindrical ring of the support bracket can be manufactured with a larger manufacturing tolerance than would be the case with a support bracket consisting of a solid ring. Such a solid ring would need to have an outer diameter which perfectly fits into the insulator tube for achieving a firm fixation of the ring to the inner surface of the insulator tube. When the cylindrical ring of the support bracket according to the invention is manufactured it is sufficient if the support bracket has an outer dimension which allows it to be inserted into the insulator tube, since the fixation of the support bracket is achieved by widening the radial slit, and thereby expanding the cylindrical ring. Also the pressure by which the support bracket according to the invention is fixed against the inner surface of the insulator tube can be adjusted. The support bracket can also easily be replaced if it is damaged inside the insulator tube by a reverse operation of the expansion assembly.

According to another embodiment of the invention the means of the expansion assembly comprises a member movable in the radial slit in a direction parallel to the cylinder axis of the cylindrical ring and having surfaces cooperating with surfaces defining said radial slit so as to expand the width of said radial slit. The member can be moved into the radial slit and thereby expand the width of the same, hence expanding the cylindrical ring to an extent so as to fix the support bracket to the inside surface of the insulator tube.

According to another embodiment of the invention the cylindrical ring has on the first end side members engageable by a tool for compressing the ring. The notches can be engaged with a tool, such as pliers, for compressing the cylindrical ring about the radial slit. In this way it is possible to insert the support bracket without damaging the fragile inner surface of the insulator tube. Also, the cylindrical ring can be inserted into the insulator tube even if the cylindrical ring in its un-compressed phase have an outer diameter which is larger than the inner diameter of the insulator tube, since the compression about the radial slit decreases said outer diameter. Of course pliers or such used for said compression have to be provided with handles or the like which are of a sufficient length for allowing them to be operated from the end of the insulator tube.

According to another embodiment of the invention the cylindrical ring has on the first end side two notches, adjacent to and on each side of the radial slit. The notches can be engaged with a tool, such as pliers, for compressing the cylindrical ring about the radial slit. In this way it is possible to insert the support bracket without damaging the fragile inner surface of the insulator tube. Also, the cylindrical ring can be inserted into the insulator tube even if the cylindrical ring in its un-compressed phase have an outer diameter which is larger than the inner diameter of the insulator tube, since the compression about the radial slit decreases said outer diameter. Of course pliers or such used for said compression have to be provided with handles or the like which are of a sufficient length for allowing them to be operated from the end of the insulator tube.

According to another embodiment of the invention said member and/or radial slit has a cross-section dimension changing in the direction parallel to the cylinder axis so as to expand the cylindrical ring upon movement of said member in said radial slit in the direction parallel to the cylinder axis. The member and/or the radial slit can thus have the shape of for instance a wedge or a distorted wedge. Thus, movement of the member in said direction in the radial slit expands the same, whereby the cylindrical ring can be expanded to an extent so as to fix the support bracket to the inside surface of the insulator tube.

According to another embodiment of the invention said member comprises a cone or a wedge configured for expanding the cylindrical ring by moving in said radial slit in the direction parallel to the cylinder axis. A cone or a wedge can penetrate the radial slit and upon movement of the cone or wedge in the direction parallel to the cylinder axis the radial slit expands, whereby the cylindrical ring can be expanded to an extent so as to fix the support bracket to the inside surface of the insulator tube.

According to another embodiment of the invention the radial slit is wider on one of the end sides than it is on the other end side so as to form a wedge-shaped radial slit, wherein said member is configured to move in the wedge-shaped radial slit and thereby expand the cylindrical ring by widening the wedge-shaped radial slit. The member can penetrate the radial slit and upon movement in the member in the direction parallel to the cylinder axis the radial slit expands, due to its wedge-shaped form, whereby the cylindrical ring can be expanded to an extent so as to fix the support bracket to the inside surface of the insulator tube.

According to another embodiment of the invention:

the expansion assembly comprises a bore in the cylindrical ring, parallel to the cylinder axis, from the first end side, the radial slit cuts through the bore, the width of the radial slit is broader on the second end side than on the first end side and the width of the radial slit from the second end side is tapering inwardly towards the bore so as to form a wedge-shaped slit from the second end side, the member comprises a bolt and a wedge, which wedge has a threaded through-hole configured for receiving the bolt by means of screwing, and the wedge is configured to be received in the mating wedge-shaped slit from the second end side and the bolt is configured to be inserted into the bore from the first end side, wherein the bolt is partially screwed into the wedge whereby the slit is expanded.

The bolt is secured in the bore of the cylindrical ring by from the second end side being screwed into the threaded through-hole of the wedge. When the bolt is screwed into the wedge, the wedge is moved in a direction parallel to the cylinder axis, towards the first end side of the cylindrical ring. The wedge is thereby penetrating into the wedge-shaped radial slit, whereby the width of the radial slit is expanded. Thus, the cylindrical ring can be expanded to an extent so as to fix the support bracket to the inside surface of the insulator tube.

According to another embodiment of the invention:

the expansion assembly comprises a bore in the cylindrical ring, parallel to the cylinder axis, from the second end side, the radial slit cuts through the bore, the width of the radial slit is broader on the first end side than on the second end side and the width of the radial slit from the first end side is tapering inwardly towards the bore so as to form a wedge-shaped slit from the first end side, the member comprises a bolt, a nut and a wedge, which wedge has a through-hole, the nut being configured to receiving the bolt via the through-hole of the wedge by means of screwing, the wedge is configured to be received in the mating wedge-shaped slit from the first end side and the bolt is configured to be inserted through the through-hole in the wedge and further through the bore, wherein the bolt is partially screwed into the nut on the second end side of the cylindrical ring.

The bolt is secured in the bore of the cylindrical ring by being screwed from the second end side into the nut. The wedge is also received in the wedge-shaped radial slit and secured therein between the bolt head and the edges of the bore. When the bolt is screwed into the nut the wedge is moved, by being pushed by the head of the bolt, in a direction parallel to the cylinder axis, towards the second end side of the cylindrical ring. The wedge is thereby penetrating into the wedge-shaped radial slit, whereby the width of the radial slit is expanded. Thus, the cylindrical ring can be expanded to an extent so as to fix the support bracket to the inside surface of the insulator tube.

According to another embodiment of the invention:

the expansion assembly comprises a cone-shaped hole in the cylindrical ring, tapering from the second end side to the first end side, wherein the centre line of the cone-shaped hole is parallel to the cylinder axis of the cylindrical ring, the radial slit cuts through the cone-shaped hole, the member comprises a bolt and a cone, which cone has a threaded through-hole configured for receiving the bolt by means of screwing, and the cone is configured to be received in the mating cone-shaped hole from the second side and the bolt is configured to be inserted into the cone-shaped hole from the first end side, with the head of the bolt abutting against the edges surrounding the hole, wherein the bolt is partially screwed into the cone whereby the slit is expanded.

The bolt is secured in the hole of the cylindrical ring by being screwed from the second end side into the threaded through-hole of the cone. When the bolt is screwed into the cone the cone is moved in a direction parallel to the cylinder axis, towards the first end side of the cylindrical ring. The cone is thereby penetrating into the cone-shaped hole, whereby the width of the radial slit is expanded. Thus, the cylindrical ring can be expanded to an extent so as to fix the support bracket to the inside surface of the insulator tube.

According to another embodiment of the invention:

the expansion assembly comprises a cone-shaped hole in the cylindrical ring, tapering from the first end side to the second end side, wherein the centre line of the cone-shaped hole is parallel to the cylinder axis of the cylindrical ring, the radial slit cuts through the cone-shaped hole, the member comprises a bolt, a nut and a cone, which cone has a through-hole, the nut being configured to receiving the bolt via the through-hole of the cone by means of screwing, the cone is configured to be received in the mating cone-shaped hole from the first end side and the bolt is configured to be inserted through the through-hole in the cone and further through the cone-shaped hole, wherein the bolt is partially screwed into the nut on the second end side of the cylindrical ring.

The bolt is secured in the hole of the cylindrical ring by being screwed from the second end side into the nut. The cone is also received in the cone-shaped hole and secured therein between the bolt head and the hole. When the bolt is screwed into the nut the cone is moved, by being pushed by the head of the bolt, in a direction parallel to the cylinder axis, towards the second end side of the cylindrical ring. The cone is thereby penetrating into the cone-shaped hole, whereby the width of the radial slit is expanded. Thus, the cylindrical ring can be expanded to an extent so as to fix the support bracket to the inside surface of the insulator tube.

Other advantages and advantageous features of the invention will appear from the dependent claims and the subsequent description.

BRIEF DESCRIPTION OF THE DRAWINGS

With reference to that appended drawings, below follows a specific description of embodiments of the invention cited as examples.

In the drawing.

DETAILED DESCRIPTION OF THE INVENTION

Explained herein are support brackets according to embodiments of the invention. The invention may, however, be embodied in many different forms and should not be construed as being limited to the exemplary embodiments set forth herein; rather, these embodiments are provided so that this disclosure will be thorough and complete, and will fully convey the concept of the invention to those skilled in the art.

Figure 1:
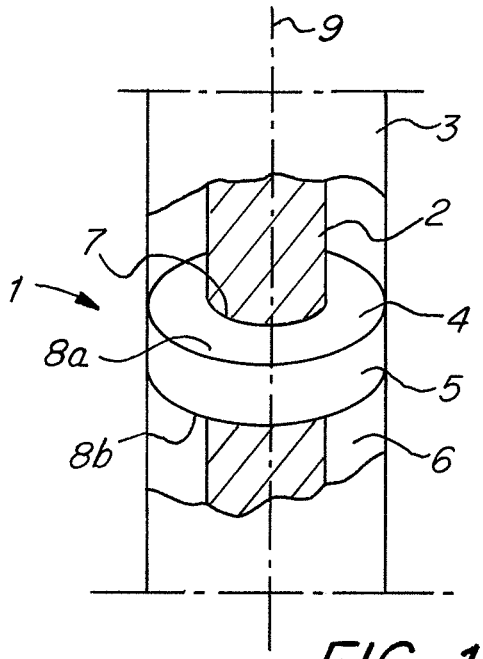
FIG. 1 shows a support bracket supporting an insulating rod inside an insulator tube.

FIG. 1 shows a support bracket 1 supporting an insulating rod 2 inside an insulator tube 3 of a hollow core insulator, for instance the supporting insulator of a live tank circuit breaker. The support bracket 1 comprises a cylindrical ring 4 with an outer surface 5 for abutting against the inner surface 6 of the insulator tube 3, an inner surface 7 for supporting the insulating rod 2 and two opposing end sides, here denominated first 8*a* and second 8*b* end sides. The support bracket 1 is configured to be inserted into the insulator tube 3 of the hollow core insulator so that the cylinder axis 9 of the cylindrical ring 4 essentially coincides with the central longitudinal axis of said insulator tube 3.

The support bracket 1 comprises an expansion assembly having means configured to be actuated so as to expand the cylindrical ring 4 in at least one radial direction when the support bracket 1 has been inserted in an insulator tube 3 of a hollow core insulator. The expansion assembly can be any expansion assembly configured for expanding the cylindrical ring 4, and in FIGS. 2-5 it is shown very schematically different embodiments of expansion means of the support bracket 1 according to the invention. The expansion assemblies shown in FIGS. 2-5 comprises a radial slit 10*a-d* which opens the cylindrical ring 4, and means of the expansion assembly is configured to be actuated so as to expand the cylindrical ring 4 by expanding the width of the radial slit 10*a-d*. The means of the expansion assembly comprises a member 11*a-d* movable in the radial slit 10*a-d* in a direction parallel to the cylinder axis 9 of the cylindrical ring 4 and having surfaces 12 cooperating with surfaces 13 defining said radial slit 10*a-d* so as to expand the width of said radial slit 10. Said member 11*a-d* and/or radial slit 10*a-d* has a cross-section dimension changing in the direction parallel to the cylinder axis 9 so as to expand the cylindrical ring 4 upon movement of said member 11*a-d* in said radial slit 10*a-d* in the direction parallel to the cylinder axis 9. Different embodiments of the member 11*a-d* and the radial slit 10*a-d* are shown in FIGS. 2-5.

Figure 2:
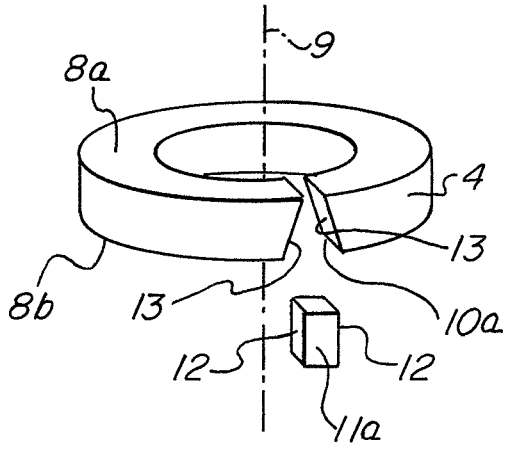
FIG. 2 shows a support bracket according to a first embodiment of the invention.

In FIG. 2 the expansion assembly is embodied with a slit 10*a* which is wider on one of the end sides 8*b* than it is on the other end side 8*a* so as to form a wedge-shaped radial slit 10*a*. The member 11*a* is configured to move in the wedge-shaped radial slit 10*a*. When the surfaces 12 of the member 11*a* come into engagement with the surfaces 13 defining said radial slit 10*a* and the member 11*a* continues to move in said direction the surfaces 13 defining said radial slit 10*a* gradually become separated and the cylindrical ring 4 is thereby expanded.

Figure 3:
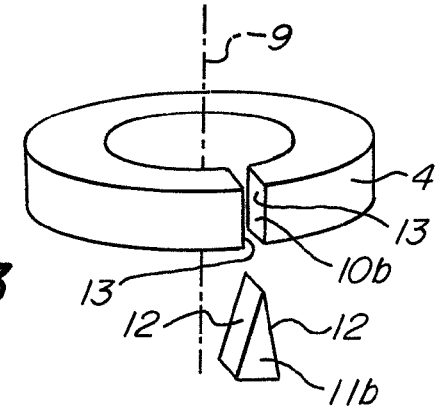
FIG. 3 shows another support bracket according to a second embodiment of the invention.

In FIG. 3 the expansion assembly is embodied with a member 11*b* in the form of a wedge configured for expanding the cylindrical ring 4 by moving in the radial slit 10*b* in the direction parallel to the cylinder axis 9. The wedge-shaped member 11*b* is configured to move in the radial slit 10*b*. When the surfaces 12 of the member 11*b* come into engagement with the surfaces 13 defining said radial slit 10*b* and the member 11*b* continues to move in said direction the surfaces 13 defining said radial slit 10*b* gradually become separated and the cylindrical ring 4 is thereby expanded.

Figure 4:
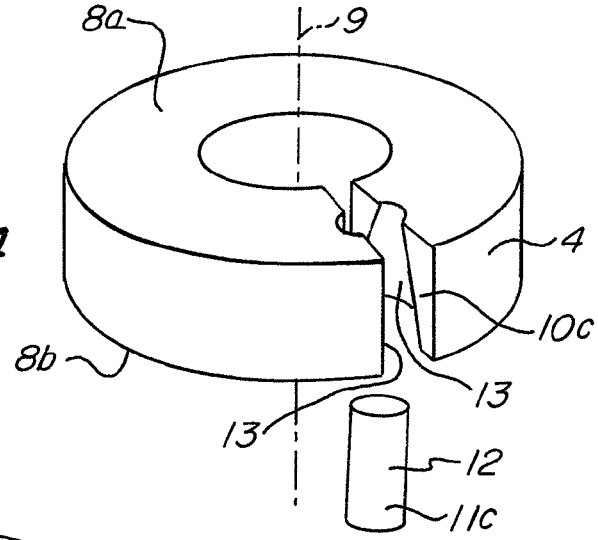
FIG. 4 shows another support bracket according to a third embodiment of the invention.

In FIG. 4 the expansion assembly comprises a cone-shaped hole in the radial slit 10*c* of the cylindrical ring 4, tapering from the second end side 8*b* to the first end side 8*a*. The centre line of the cone-shaped hole is parallel to the cylinder axis 9 of the cylindrical ring 4. The member 11*c* is here in the form of a circular cylinder and is configured to move in the cone-shaped hole of the radial slit 10*c*. When the surfaces 12 of the member 11*c* come into engagement with the surfaces 13 defining said hole and the member 11*c* continues to move in said direction the surfaces 13 defining said hole gradually become separated, which separates the radial slit 10*c*, and the cylindrical ring 4 is thereby expanded.

Figure 5:
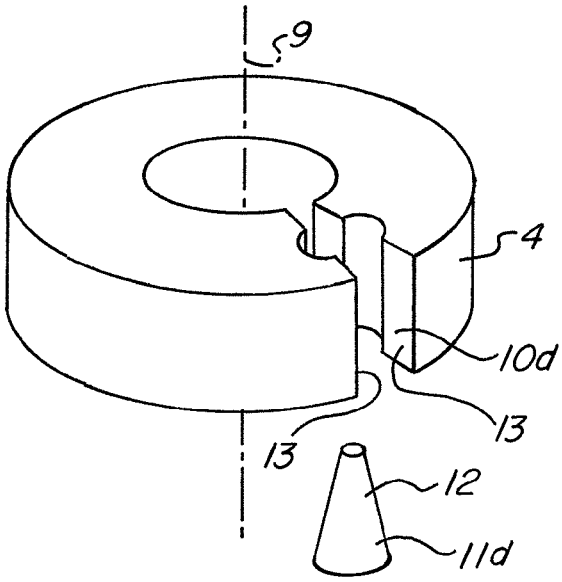
FIG. 5 shows another support bracket according to a fourth embodiment of the invention.

In FIG. 5 the expansion assembly is embodied with a member 11*d* in the form of a cone configured for expanding the cylindrical ring 4 by moving in a hole divided by the radial slit 10*d* in the direction parallel to the cylinder axis 9. The cone-shaped member 11*d* is configured to move in the hole of the radial slit 10*d*. When the surfaces 12 of the member 11*d* come into engagement with the surfaces 13 defining said hole of the radial slit 10*d* and the member 11*d* continues to move in said direction the surfaces 13 defining said hole of the radial slit 10*d* gradually become separated and the cylindrical ring 4 is thereby expanded.

Figure 6:
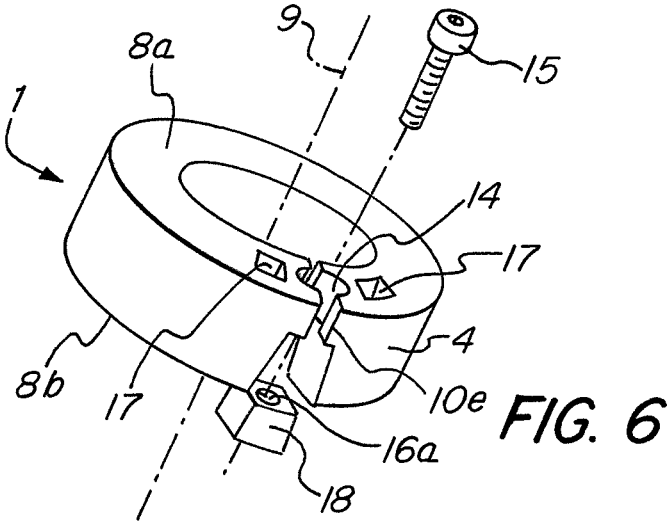
FIG. 6 shows another support bracket according to a fifth embodiment of the invention.

In FIG. 6 it is shown a support bracket 1 according to the invention, wherein the expansion assembly comprises a bore 14 in the cylindrical ring 4, parallel to the cylinder axis 9, from the first end side 8*a*. The radial slit 10*e* cuts through the bore 14 and the width of the radial slit 10*e* is broader on the second end side 8*b* than on the first end side 8*a* and the width of the radial slit 10*e* from the second end side 8*b* is tapering inwardly towards the bore 14 so as to form a wedge-shaped slit from the second end side 8*b*. The member, movable in the radial slit in a direction parallel to the cylinder axis 9 of the cylindrical ring 4, comprises a bolt 15 and a wedge 18, which wedge 18 has a threaded through-hole 16*a* configured for receiving the bolt 15 by means of screwing. The wedge 18 is configured to be received in the mating wedge-shaped slit 10*e* from the second end side 8*b* and the bolt 15 is configured to be inserted into the bore 14 from the first end side 8*a*. The bolt 15 is partially screwed into the wedge 18 whereby the wedge 18 is pushing the surfaces of wedge-shaped slit apart, which expands the slit 10*e*. The cylindrical ring 4 has on the first end side 8*a* two notches 17, adjacent to and on each side of the radial slit 10*e*. The notches 17 can be engaged with a tool, such as pliers, for compressing the cylindrical ring 4 about the radial slit 10*e*. In this way it is possible to insert the support bracket 1 without damaging the fragile inner surface of the insulator tube.

Figure 7:
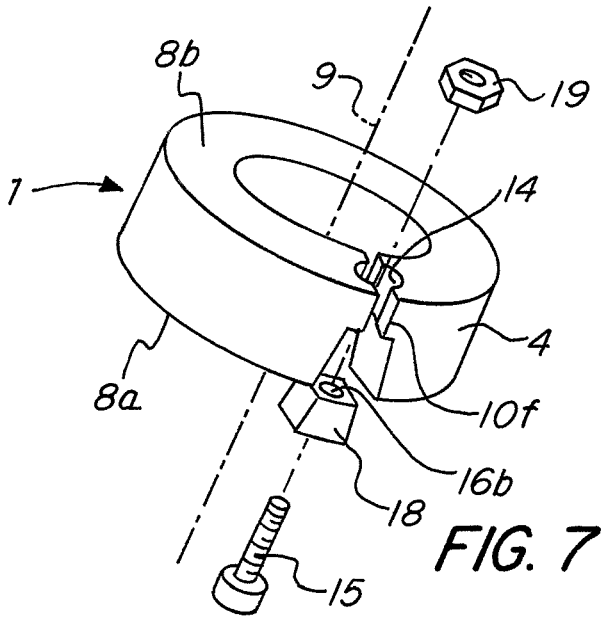
FIG. 7 shows another support bracket according to a sixth embodiment of the invention.

In FIG. 7 it is shown a support bracket 1 according to the invention, wherein the expansion assembly comprises a bore 14 in the cylindrical ring 4, parallel to the cylinder axis 9, from the second end side 8*b*. The radial slit 10*f* cuts through the bore 14 and the width of the radial slit 10*f* is broader on the first end side 8*a* than on the second end side 8*b* and the width of the radial slit 10*f* from the first end side is 8*a* tapering inwardly towards the bore 14 so as to form a wedge-shaped slit from the first end side 8*a*. The member comprises a bolt 15, a nut 19 and a wedge 18, which wedge 18 has a through-hole 16*b*. The nut 19 is configured to receive the bolt 15 via the through-hole 16*b* of the wedge 18 by means of screwing. The wedge 18 is configured to be received in the mating wedge-shaped slit from the first side 8*a* and the bolt 15 is configured to be inserted through the through-hole 16*b* in the wedge 18 and further through the bore 14, wherein the bolt 15 is partially screwed into the nut 19 on the second side 8*b* of the cylindrical ring 4.

Figure 8:
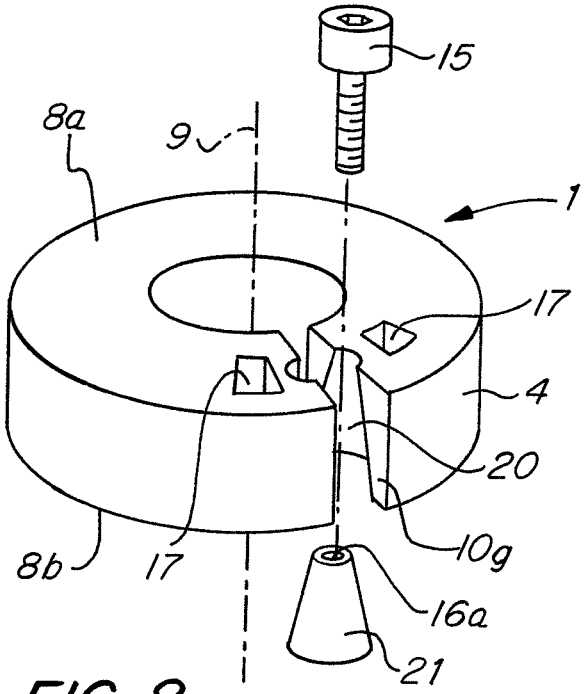
FIG. 8 shows another support bracket according to a seventh embodiment of the invention.

In FIG. 8 it is shown a support bracket 1 according to the invention, wherein the expansion assembly comprises a cone-shaped hole 20 in the cylindrical ring 4, tapering from the second end side 8*b* to the first end side 8*a*. The centre line of the cone-shaped hole 20 is parallel to the cylinder axis 9 of the cylindrical ring 4 and the radial slit 10*g* cuts through the cone-shaped hole 20. The member comprises a bolt 15 and a cone 21, which cone 21 has a threaded through-hole 16*a* configured for receiving the bolt 15 by means of screwing. The cone 21 is configured to be received in the mating cone-shaped hole 20 from the second end side 8*b* and the bolt 15 is configured to be inserted into the cone-shaped hole 20 from the first end 8*a* side, with the head of the bolt 15 abutting against the edges surrounding the hole on the first end side 8*a*. The bolt 15 is partially screwed into the cone 21 whereby the radial slit 10*g* is widened and the cylindrical ring 4 expanded. The cylindrical ring 4 has on the first end side 8*a* two notches 17, adjacent to and on each side of the radial slit 10*g*. The notches 17 can be engaged with a tool, such as pliers, for compressing the cylindrical ring 4 about the radial slit 10*g*. In this way it is possible to insert the support bracket 1 without damaging the fragile inner surface of the insulator tube.

Figure 9:
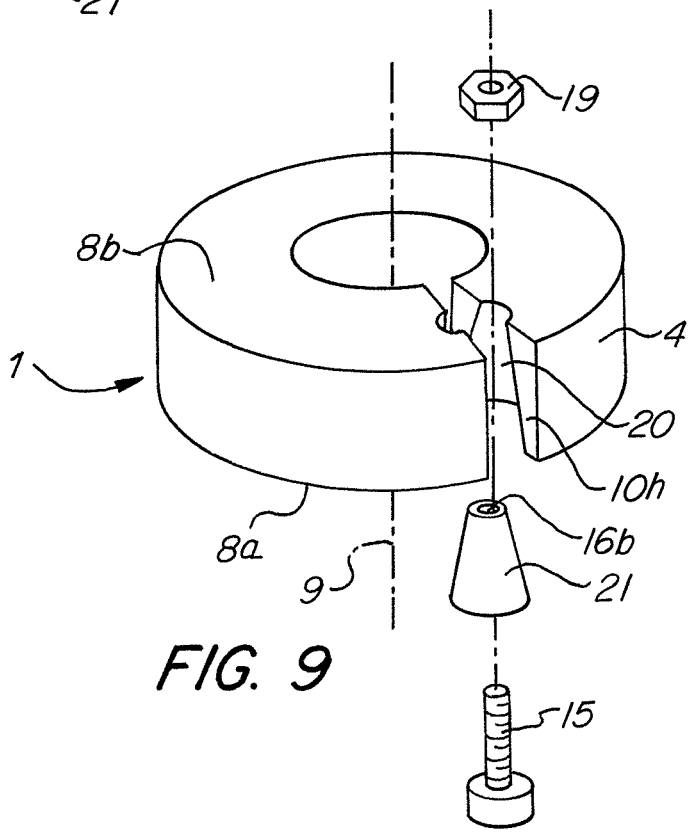
FIG. 9 shows another support bracket according to the invention.

In FIG. 9 it is shown a support bracket 1 according to the invention, wherein the expansion assembly comprises a cone-shaped hole 20 in the cylindrical ring 4, tapering from the first end side 8*a* to the second end side 8*b*. The centre line of the cone-shaped hole 20 is parallel to the cylinder axis 9 of the cylindrical ring 4 and the radial slit 10*h* cuts through the cone-shaped hole 20. The member comprises a bolt 15, a nut 19 and a cone 21, which cone 21 has a through-hole 16*b*. The nut 19 is configured to receiving the bolt 15 via the through-hole 16*b* of the cone 21 by means of screwing. The cone 21 is configured to be received in the mating cone-shaped hole 20 from the first end side 8*a* and the bolt 15 is configured to be inserted through the through-hole 16*b* in the cone 21 and further through the cone-shaped hole 20. The bolt 15 is partially screwed into the nut 19 on the second end side 8*b* of the cylindrical ring 4.

The invention is of course not in any way limited to the embodiments described above. On the contrary, several possibilities to modifications thereof should be apparent to a person skilled in the art without departing from the basic idea of the invention as defined in the appended claims.

What is claimed is:

1. A support bracket for supporting insulating rods inside an insulator tube of a hollow core insulator, the support bracket comprising:

a cylindrical ring with an outer surface for abutting against the inner surface of an insulator tube, an inner surface for supporting an insulating rod and two opposing end sides, denominated as first and second end sides, the support bracket being configured to be inserted into an insulator tube of a hollow core insulator so that the cylinder axis of the cylindrical ring essentially coincides with the central longitudinal axis of said insulator tube, characterized in that the support bracket comprises an expansion assembly having means configured to be actuated so as to expand the cylindrical ring in at least one radial direction when the support bracket has been inserted in an insulator tube of a hollow core insulator.

2. The support bracket of claim 1, characterized in that said means is accessible for actuation from the first end side of the cylindrical ring.

3. The support bracket of claim 1, characterized in that the expansion assembly comprises a radial slit which opens the cylindrical ring, and that said means of the expansion assembly is configured to be actuated so as to expand the cylindrical ring by expanding the width of the radial slit.

4. The support bracket of claim 3, characterized in that the means of the expansion assembly comprises a member movable in the radial slit in a direction parallel to the cylinder axis of the cylindrical ring and having surfaces cooperating with surfaces defining said radial slit so as to expand the width of said radial slit.

5. The support bracket of claim 3, characterized in that the cylindrical ring on the first end side has members engageable by a tool for compressing the ring.

6. The support bracket of claim 3, characterized in that the cylindrical ring on the first end side has two notches, adjacent to and on each side of the radial slit.

7. The support bracket of claim 4, characterized in that said member and/or radial slit has a cross-section dimension changing in the direction parallel to the cylinder axis so as to expand the cylindrical ring upon movement of said member in said radial slit in the direction parallel to the cylinder axis.

8. The support bracket of claim 7, characterized in that said member comprises a cone or a wedge configured for expanding the cylindrical ring by moving in said radial slit in the direction parallel to the cylinder axis.

9. The support bracket according to claim 7, characterized in that the radial slit is wider on one of the end sides than it is on the other end side so as to form a wedge-shaped radial slit, wherein said member is configured to move in the wedge-shaped radial slit and thereby expand the cylindrical ring by widening the wedge-shaped radial slit.

10. The support bracket of claim 3, characterized in that:

the expansion assembly comprises a bore in the cylindrical ring, parallel to the cylinder axis, from the first end side, the radial slit cuts through the bore, the width of the radial slit is broader on the second end side than on the first end side and the width of the radial slit from the second end side is tapering inwardly towards the bore so as to form a wedge-shaped radial slit from the second end side, the member comprises a bolt and a wedge, which wedge has a threaded through-hole configured for receiving the bolt by means of screwing, and the wedge is configured to be received in the mating wedge-shaped radial slit from the second end side and the bolt is configured to be inserted into the bore from the first end side, wherein the bolt is partially screwed into the wedge whereby the radial slit is expanded.

11. The support bracket of claim 3, characterized in that:

the expansion assembly comprises a bore in the cylindrical ring, parallel to the cylinder axis, from the second end side, the radial slit cuts through the bore, the width of the radial slit is broader on the first end side than on the second end side and the width of the radial slit from the first end side is tapering inwardly towards the bore so as to form a wedge-shaped radial slit from the first end side, the member comprises a bolt, a nut and a wedge, which wedge has a through-hole, the nut being configured to receiving the bolt via the through-hole of the wedge by means of screwing, the wedge is configured to be received in the mating wedge-shaped radial slit from the first end side and the bolt is configured to be inserted through the through-hole in the wedge and further through the bore, wherein the bolt is partially screwed into the nut on the second end side of the cylindrical ring.

12. The support bracket of claim 3, characterized in that:

the expansion assembly comprises a cone-shaped hole in the cylindrical ring, tapering from the second end side to the first end side, wherein the centre line of the cone-shaped hole is parallel to the cylinder axis of the cylindrical ring, the radial slit cuts through the cone-shaped hole, the member comprises a bolt and a cone, which cone has a threaded through-hole configured for receiving the bolt by means of screwing, and the cone is configured to be received in the mating cone-shaped hole from the second end side and the bolt is configured to be inserted into the cone-shaped hole from the first end side, with the head of the bolt abutting against the edges surrounding the cone-shaped hole from the first end side, wherein the bolt is partially screwed into the cone whereby the radial slit is expanded.

13. The support bracket according to claim 3, characterized in that:

the expansion assembly comprises a cone-shaped hole in the cylindrical ring, tapering from the first end side to the second end side, wherein the centre line of the cone-shaped hole is parallel to the cylinder axis of the cylindrical ring, the radial slit cuts through the cone-shaped hole, the member comprises a bolt, a nut and a cone, which cone has a through-hole, the nut being configured to receiving the bolt via the through-hole of the cone by means of screwing, the cone is configured to be received in the mating cone-shaped hole from the first end side and the bolt is configured to be inserted through the through-hole in the cone and further through the cone-shaped hole, wherein the bolt is partially screwed into the nut on the second end side of the cylindrical ring whereby the radial slit is expanded.

14. A method for using a support bracket of claim 1 for supporting insulating rods inside an insulator tube of a hollow core insulator.

* * * * *